US008322762B2

(12) United States Patent
Watson

(10) Patent No.: US 8,322,762 B2
(45) Date of Patent: Dec. 4, 2012

(54) DOOR GAP ADJUSTMENT FOR A MOTOR VEHICLE

(75) Inventor: Scott Richard Watson, Novi, MI (US)

(73) Assignee: Nissan North America, Inc., Franklin, TN (US)

( * ) Notice: Subject to any disclaimer, the term of this patent is extended or adjusted under 35 U.S.C. 154(b) by 773 days.

(21) Appl. No.: 12/395,290

(22) Filed: Feb. 27, 2009

(65) Prior Publication Data

US 2010/0219648 A1 Sep. 2, 2010

(51) Int. Cl.
*E05C 17/54* (2006.01)

(52) U.S. Cl. ..... 292/343; 292/342; 292/DIG. 53

(58) Field of Classification Search ..... 296/146.1, 296/146.5, 146.8, 146.9, 187, 207; 16/82, 16/86 A, 86 B, 86 R; 292/342, 343, DIG. 53
See application file for complete search history.

(56) References Cited

U.S. PATENT DOCUMENTS

| | | | | |
|---|---|---|---|---|
| 4,569,547 | A * | 2/1986 | Fayerman et al. | 292/347 |
| 5,421,124 | A * | 6/1995 | Zuccaro | 49/381 |
| 5,791,723 | A * | 8/1998 | Bell et al. | 296/155 |
| 6,039,389 | A * | 3/2000 | Monette et al. | 296/207 |
| 6,189,959 | B1 * | 2/2001 | VanAssche et al. | 296/207 |
| 6,676,201 | B2 | 1/2004 | Im et al. | |
| 7,014,258 | B2 * | 3/2006 | Schubring et al. | 296/207 |
| 7,229,108 | B2 * | 6/2007 | Hochrein | 293/128 |
| 7,308,731 | B2 * | 12/2007 | Schubring et al. | 16/86 R |
| 7,607,719 | B2 * | 10/2009 | Abraham et al. | 296/187.03 |
| 7,681,281 | B2 * | 3/2010 | Schubring et al. | 16/86 B |
| 7,730,580 | B2 * | 6/2010 | Mokashi et al. | 16/86 R |
| 7,743,915 | B2 * | 6/2010 | Murphy | 206/273 |
| 7,789,383 | B2 * | 9/2010 | Grizzell | 270/58.08 |
| 2006/0082187 | A1 * | 4/2006 | Hernandez et al. | 296/146.1 |
| 2006/0244286 | A1 * | 11/2006 | Meyers et al. | 296/146.1 |
| 2007/0271731 | A1 * | 11/2007 | Fuller | 16/82 |

* cited by examiner

*Primary Examiner* — Carlos Lugo
*Assistant Examiner* — Mark Williams
(74) *Attorney, Agent, or Firm* — Young, Basile, Hanlon & MacFarlane, P.C.

(57) ABSTRACT

A vehicle includes a vehicle body defining an opening, a door, and an adjustable wedge assembly. The door is mounted to the body for movement between an open position, wherein doors are disposed within the opening, and an open position, wherein the doors are at least partially outside of the opening. The adjustable wedge assembly includes a base portion fixed to one of the vehicle body and the door, and a wedge portion movable relative to the base portion between a plurality of positions including an outboard position, an inboard position and at least one intermediate position between the outboard position and the inboard position. A contact surface os disposed on one of the vehicle body and the door opposite the wedge portion. A spacer is removably attached to one of the wedge portion and the contact surface during assembly of the vehicle, wherein the wedge portion and the contact surface are positioned so that the spacer is interposed between and in engagement with the contact surface and the wedge when the door is moved from the open position to the closed position during assembly of the vehicle. A mechanism is provided to fix the position of the wedge portion relative to the base portion after the door moves from the open to the closed position during assembly of the vehicle.

21 Claims, 6 Drawing Sheets

DOOR GAP ADJUSTMENT FOR A MOTOR VEHICLE

FIELD OF THE INVENTION

The invention relates to the field of doors for motor vehicles, and more particularly, to an apparatus and method for establishing and maintaining a uniform gap between the door and door frame of a motor vehicle.

BACKGROUND OF THE INVENTION

On certain vehicle doors, large tolerances exist between the door and the door frame that defines an opening in the vehicle body. Thus, in order to establish a desired gap between such doors, it is known to provide a pair of complementary wedge-shaped blocks on the lateral sides each of the door and door frame, such that the blocks engage one another to define the position of the door with respect to the door frame when the door is in a closed position. It is also known to provide wedge-shaped blocks that are adjustable with respect to the vehicle body to facilitate installation and adjustment of the door with respect to the door frame. However, during the lifespan of the motor vehicle, usage of the door along with vibrations experienced during operation of the vehicle tend to cause such doors to sag, thereby deviating from their initial installed positions.

SUMMARY

Apparatuses and methods for door gap adjustment for a motor vehicle are taught herein. According to an apparatus taught herein, a vehicle includes a vehicle body defining an opening, a door, and an adjustable wedge assembly. The door is mounted to the body for movement between a closed position, wherein doors are disposed within the opening, and an open position, wherein the doors are at least partially outside of the opening. The adjustable wedge assembly includes a base portion fixed to one of the vehicle body and the door, and a wedge portion movable relative to the base portion between a plurality of positions including an outboard position, an inboard position and at least one intermediate position between the outboard position and the inboard position. A contact surface is disposed on one of the vehicle body and the door opposite the wedge portion. A spacer is removably attached to one of the wedge portion and the contact surface during assembly of the vehicle, wherein the wedge portion and the contact surface are positioned so that the spacer is interposed between and in engagement with the contact surface and the wedge when the door is moved from the open position to the closed position during assembly of the vehicle. A mechanism is provided to fix the position of the wedge portion relative to the base portion after the door moves from the open to the closed position during assembly of the vehicle.

The spacer could be attached to the wedge portion so that the spacer is interposed between the wedge portion and the contact surface when the door moves from the open position to the closed position during assembly of the vehicle.

At least one of the spacer and the contact surface could include locator pins and the other of the spacer and the contact surface could define apertures corresponding to the locator pins and sized to snugly receive the locator pins, wherein the locator pins and apertures are configured to align the spacer with respect to the wedge portion. Alternatively, at least one of the spacer and the wedge portion could include locator pins and the other of the spacer and the wedge portion could define apertures corresponding to the locator pins and sized to snugly receive the locator pins, wherein the locator pins and apertures are configured to align the spacer with respect to the wedge portion.

The spacer could be contoured to snugly engage at least two surfaces of the wedge portion.

The spacer could have a thickness of between about 1 mm and about 5 mm. Furthermore, the spacer could be made of a rigid material.

The vehicle could include a striker portion defining the contact surface. The striker portion could have a wedge surface aligned with the wedge portion of the adjustable wedge assembly when the door is in the closed position.

The outboard position, the inboard position and the at least one intermediate position could each defined by a detent located on one of the base portion and the wedge portion.

The mechanism could include at least one of a detent or a fastener.

In one method for assembling a vehicle taught herein, the vehicle has a vehicle body defining an opening. The method includes the steps of pivotally attaching a door to the vehicle body so that the door is movable between an open position and a closed position; attaching an adjustable wedge assembly to one of the vehicle body and the door, the adjustable wedge including a base portion fixed to one of the vehicle body and the door, and a wedge portion movable relative to the base between a plurality of positions including an outboard position, and inboard position and at least one intermediate position between the outboard position and the inboard position, wherein the adjustable wedge assembly is configured and arranged so that the adjustable wedge assembly comes into contact with a contact surface located on the other of the door and the body when the door is in the closed position; placing a spacing member on one of the contact surface or the wedge portion; placing the wedge portion in the outboard position; moving the door to the closed position so that the spacer is interposed between and in engagement with the contact surface and the wedge to move the wedge portion from the outboard position to one of the inboard position and the intermediate position; moving the door to the open position; removing the spacing member; and fixing the position of the wedge relative to the base portion.

The spacer could be of a thickness of between about 1 mm and about 5 mm.

At least one of the spacer and the contact surface could include locator pins and the other of the spacer and the contact surface could define apertures corresponding to the locator pins and sized to snugly receive the locator pins, wherein the locator pins and apertures are configured to align the spacer with respect to the wedge portion. Alternatively, at least one of the spacer and the wedge portion could include locator pins and the other of the spacer and the wedge portion could define apertures corresponding to the locator pins and sized to snugly receive the locator pins, wherein the locator pins and apertures are configured to align the spacer with respect to the wedge portion.

The spacing member could be contoured to snugly engage at least two surfaces of the wedge portion.

The outboard position, the inboard position and the at least one intermediate position could each be defined by a detent located on one of the base portion and the wedge portion.

In another method for assembling a vehicle taught herein, the vehicle has a body with an opening. The method include the steps of attaching a door to the vehicle body so that the door is movable between an open position and a closed position; attaching an adjustable wedge assembly to one of the vehicle body and the door, the adjustable wedge including a base portion fixed to one of the vehicle body and the door, and a wedge portion movable relative to the base between a plurality of positions including an outboard position, an inboard position and at least one intermediate position between the outboard position and inboard position, wherein the adjustable wedge assembly is configured and arranged so that the adjustable wedge assembly comes into contact with a contact surface located on the other of the door and the body when the door closes the opening; placing the wedge portion in the outboard position; closing the door to move the wedge portion one or more positions away from the outboard position to one of the intermediate positions; opening the door; moving the wedge portion at least one more position away from the outboard position; and fixing the position of the wedge portion relative to the base portion.

The adjustable wedge assembly could include indicia located on one of the base portion and the wedge portion, the indicia corresponding to at least two positions.

The outboard position, the inboard position and the at least one intermediate position could each be defined by a detent located on one of the base portion and the wedge portion.

BRIEF DESCRIPTION OF THE DRAWINGS

The description herein makes reference to the accompanying drawings wherein like referenced numerals refer to like parts throughout the several views, and wherein.

DETAILED DESCRIPTION

Figure 1:
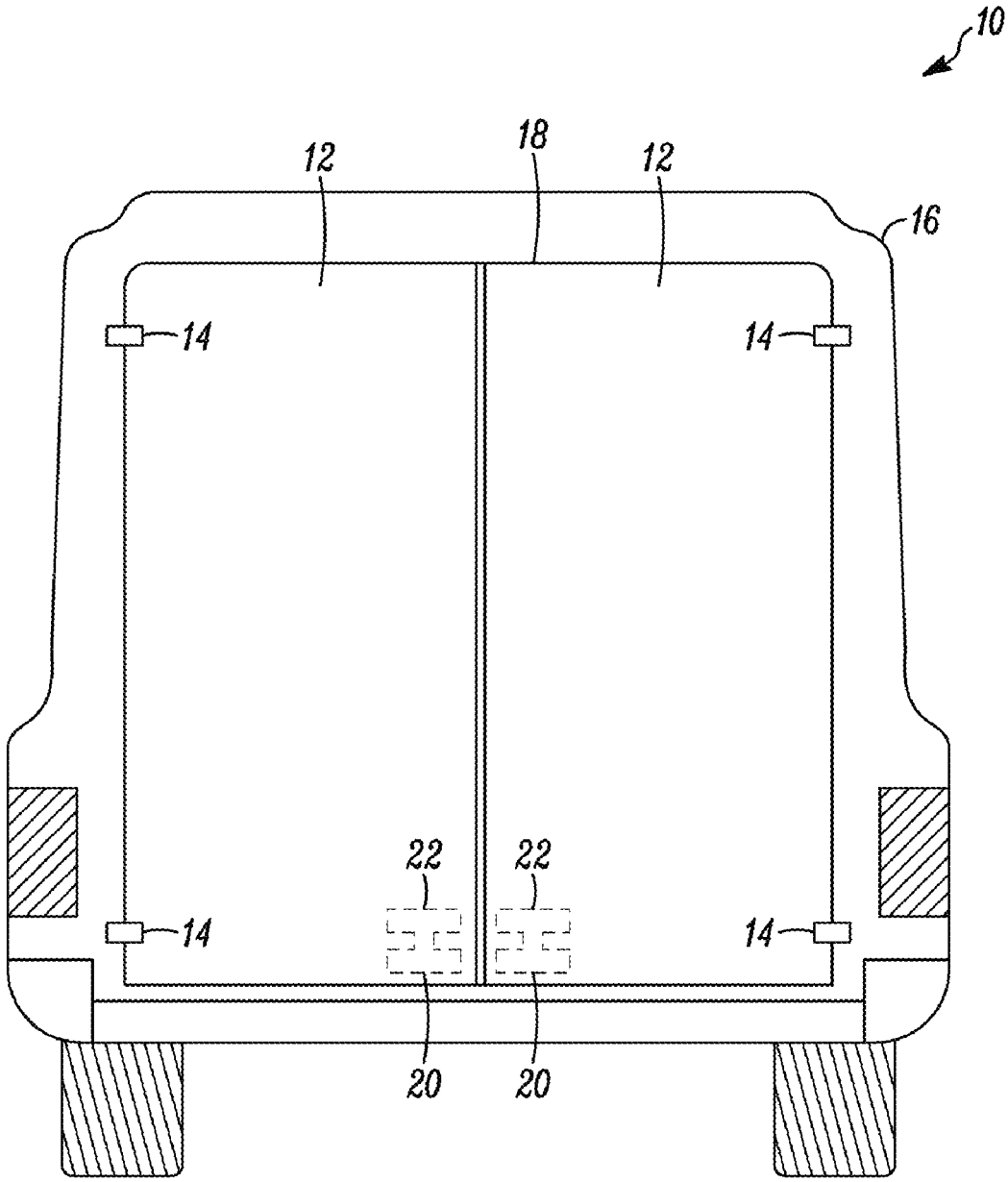
FIG. 1 is a rear view of a vehicle in accordance with an embodiment of the invention.

FIG. 1 shows a vehicle 10 having one or more doors 12 that are mounted on hinges 14 for motion with respect to a vehicle body 16 for movement of the doors 12 into and out of an opening 18 defined in the vehicle body 16. In particular, the doors 12 move between an open position, wherein doors 12 are disposed within the opening 18, and an open position, wherein the doors 12 are at least partially outside of the opening 18. The opening 18 may be located anywhere on the vehicle body 16, and the doors 12 may pivotally mounted, slidably mounted, or mounted in any other suitable fashion to the vehicle body 12. In the embodiment shown and described herein, the doors 12 include a pair of opposed pivotally mounted doors 12 that engage one another upon closing without having a structural pillar of the vehicle body 16 disposed between them. In particular, the hinges 14 establish a generally upright or substantially vertical axis of rotation for each door 12 with respect to the vehicle body 16, and the doors 12 are mounted such that they swing inward toward one another into the opening 18 to define a closed position for the doors 12.

In order to prevent the doors 12 from sagging with respect to the vehicle body 16 by more than a predetermined distance from their initial installation positions, each of the doors 12 is provided with an adjustable wedge assembly 20. In particular, the weight of the doors 12, as well as wear and tear to the vehicle 10 causes the doors to sag from their initial positions over time. However, by initially spacing a contact surface by a predetermined distance with respect to the adjustable wedge assemblies 20, the sagging is accommodated, and the adjustable wedge assemblies 20 support the doors 12 after the doors 12 have sagged by the predetermined distance.

The adjustable wedge assemblies 20 are shown and described herein as being affixed to the vehicle body 16, but could alternatively be affixed to each of the doors 12. Each adjustable wedge assembly 20 is located in a gap that is defined between a bottom surface of each of the doors 12 and a generally horizontal surface of the vehicle body 16. Each adjustable wedge assembly 20 is engageable with the contact surface, which can be a portion of the vehicle body 16 or the doors 12, whichever is opposite the adjustable wedge assembly 20. Alternatively, the contact surface could be provided on a striker 22 that is connected to one of the vehicle body 16 or the doors 12. When initially installed, the adjustable wedge assembly 20 is separated from the contact surface by a predetermined gap. Subsequently, engagement of the adjustable wedge assembly 20 with the contact surface prevents the doors 12 from deviating from their initial position by more than the predetermined gap.

Figure 2:
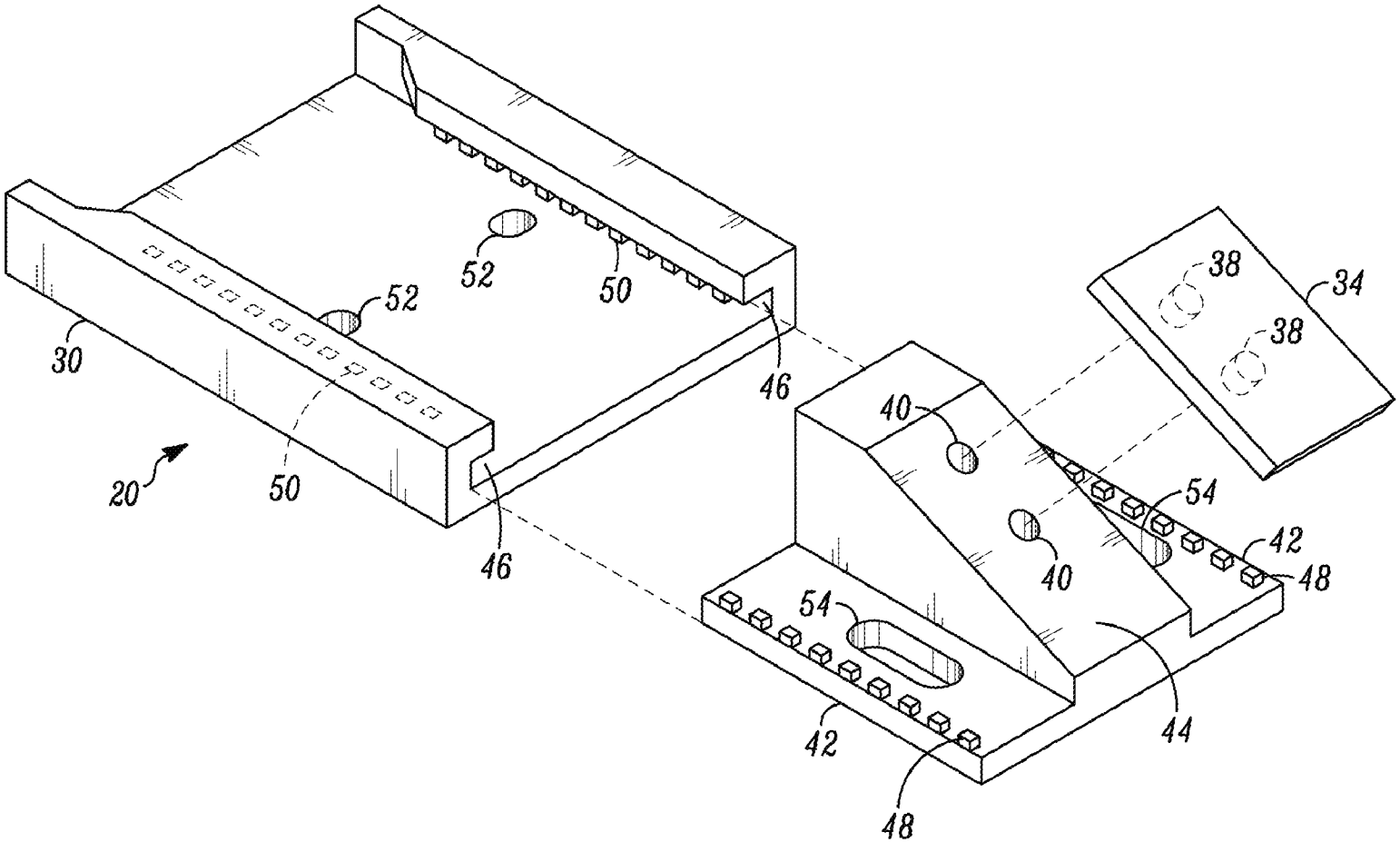
FIG. 2 is an exploded perspective view of the wedge assembly in accordance with a first embodiment of the invention.

As shown in FIG. 2, the wedge assembly 20 includes a base portion 30 and a wedge portion 32 having a triangular profile that are moveable with respect to one another during assembly of the vehicle 10. A spacer 34 is removably connected to the wedge portion 32 to allow the predetermined gap to be established between the doors 12 and the vehicle body 16 of the vehicle 10, as will be explained herein. While the wedge assembly 20 may include a structure having a triangular profile, it is noted that there term wedge, as used herein, is not limited to any particular geometric structure, but rather, encompasses any geometry suitable for engagement with an opposed contact surface.

The base portion 30 is includes a pair of opposed, u-shaped channels 46 that extend longitudinally along the base portion 30. The u-shaped channels 46 are sized and positioned with respect to one another so that the wedge portion 32 of the wedge assembly 20 is receivable within the u-shaped channels 46 in a sliding relationship with respect to the base portion 30. A plurality of detents 50 are provided on the base portion 30. The detents 50 of the base portion 30 can be arrayed longitudinally on the base portion 30, and can be formed within the u-shaped channels 46. Mounting apertures 52 or other suitable structures are provided to connect the base portion 30 to one of the doors 12 or the vehicle body 16 of the vehicle 12.

The wedge portion 32 includes a pair of laterally-extending flange portions 42 that are formed on opposite sides of an inclined surface 44. The flanges 42 are receivable within the U-shaped channels 46 of the base portion 30 so that sliding motion of the wedge portion 32 with respect to the base portion 30 is constrained to the fore and aft directions of the adjustable wedge assembly 20. A plurality of detents 48 are formed on the flanges 42 of the wedge portion 32. Elongate mounting slots 54 or other suitable structures are provided to connect the wedge portion 32 to the base portion 30 as well as to one of the doors 12 or the vehicle body 16 of the vehicle 12.

The detents 48 of the wedge portion 32 are engagable with the detents 50 on the base portion 30 during sliding of the wedge portion 32 with respect to the base portion 30. In particular, engagement of the detents 48 of the wedge portion 32 with the detents 50 establishes a plurality of discrete positions in which the wedge portion 32 may be disposed with respect to the base portion 30. These positions include an outboard position, which is the position in which the wedge portion 30 or spacer 34 would be engaged by the striker 22 earliest during movement of the door 12 from the open position to the closed position, and an inboard position, which is the position in which the wedge portion 30 or spacer 34 would be engaged by the striker 22 latest during movement of the door 12 from the open position to the closed position. For example, in the illustrated embodiment, the wedge portion 32 is in the outboard position when it is at or near its closest to the exterior of the vehicle 10, and the wedge portion 32 is in the inboard position when it is at or near its closest to the interior of the vehicle 10.

The detents 48, 50 on the wedge portion 32 and the base portion 30 are cooperatively sized and configured to resist sliding motion of the wedge portion 32 with respect to the base portion 30. However, the detents 48, 50 do not, by themselves, prevent sliding motion of the wedge portion 32 with respect to the base portion 30. Rather, despite cooperative engagement of the detents 48, 50, the wedge portion 32 may still slide with respect to the base portion 30 upon application of sufficient force to the wedge portion 32.

A spacer 34 is removably attached to the wedge portion 32 of the adjustable wedge assembly 20. The spacer 34 allows a predetermined gap to be established between the wedge portion 32 of the wedge assembly 20 and the striker 22 during assembly of the vehicle 10. For example, the predetermined gap could be between 1 mm and 5 mm, and furthermore, the predetermined gap could be about 2 mm. The spacer 34 is substantially planar and has a thickness corresponding to the predetermined gap between the wedge portion 32 and the striker 22. The spacer 34 is adapted to engage the wedge portion 32 of the adjustable wedge assembly 20 such that the spacer 34 remains in a substantially fixed position with respect to the wedge portion 32 during assembly of the vehicle 10. For example, a pair of cylindrical posts 38 may be provided on a lower surface of the spacer 34 such that the posts 38 are receivable within a pair of complementary apertures 40 that are provided on the wedge portion 32 of the adjustable wedge assembly 20. Once the desired spacing has been established between the contact surface 26 and the wedge portion 32, the spacer 34 can be removed from the wedge portion 32 of the adjustable wedge assembly 20, as will be explained in further detail herein.

Figure 3:
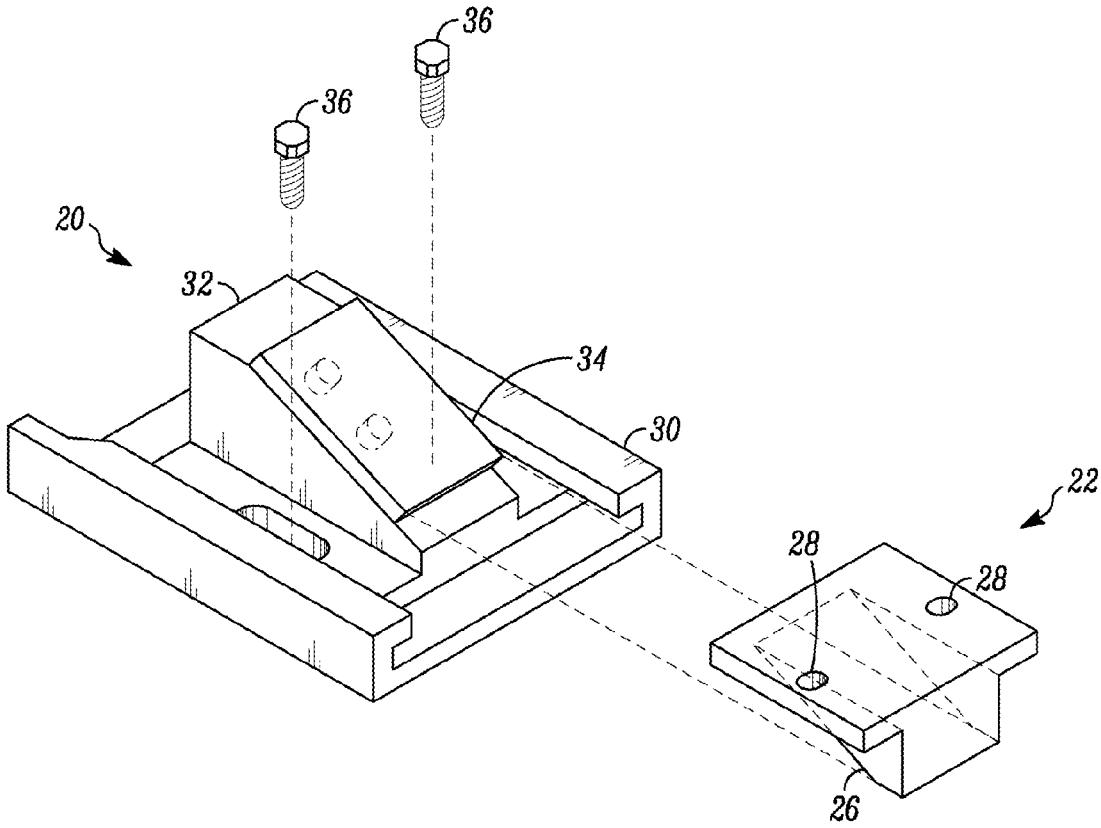
FIG. 3 is a perspective view of the wedge assembly and a striker.
Figure 4:
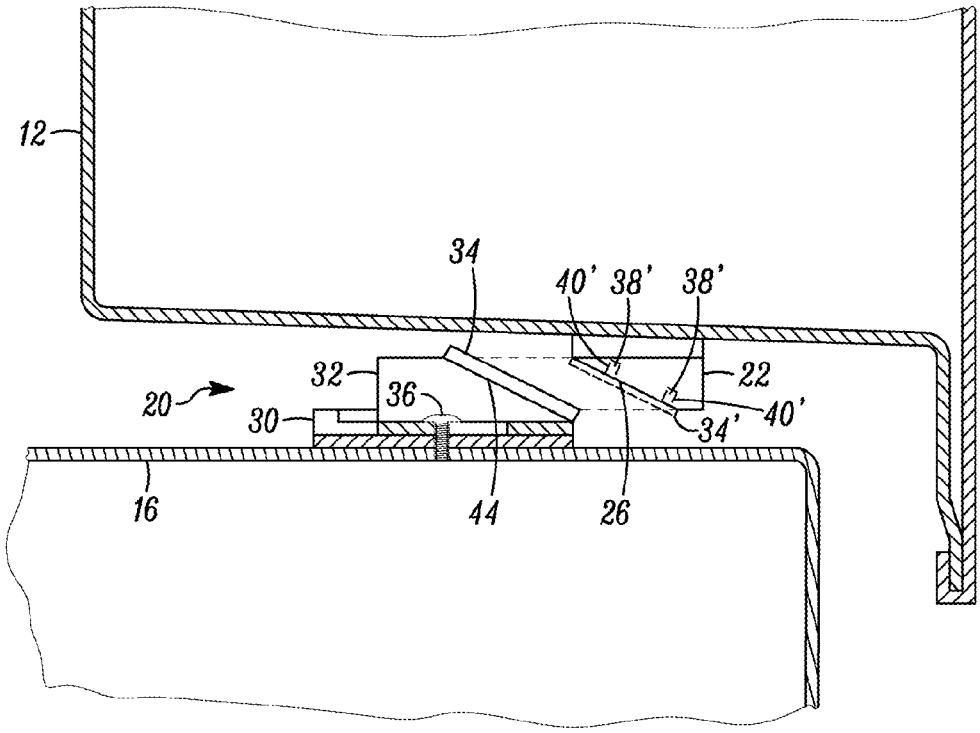
FIG. 4 is a sectional view of the vehicle of FIG. 1, showing the position of the wedge assembly and striker within a gap between the door and the body.

As shown in FIGS. 3-4, the striker 22 has a base member 24 and an inclined contact surface 26 that extends at an angle with respect to the base member 24 and establishes a triangular profile for the striker 22. The base member 24 includes a pair of mounting apertures 28 that facilitate connection of the striker 22 to the doors 12 of the vehicle body 16 of the vehicle 10, using standard fasteners. While the striker 22 is shown and described herein as having an inclined surface 26 that defines a triangular profile for the striker 22, it should be understood that the striker 22 is not limited to any particular shape, but rather, could be any shape suitable to engage the wedge portion 32 of the adjustable wedge assembly 20 and/or the spacer 34. Furthermore, while the spacer 34 has been previously described as being connectable to the wedge portion 32, it should be understood that a spacer 34' could be connectable to the contact surface 24 of the striker 22, by providing apertures 40' in the striker 22 for receiving posts 38' of the spacer 34' therein.

During assembly of the vehicle 10, the position of the wedge portion 32 of the adjustable wedge assembly 20 with respect to the base portion is set by closing a respective door 12 of the vehicle 12. Doing so causes the contact surface 24 of the striker 22 to engage the spacer 34, such that the spacer 34 is interposed between the striker 22 and the adjustable wedge assembly 20. The door 12 is closed with sufficient force to cause the wedge portion 32 of the adjustable wedge assembly 20 to move, against the restraining force of the detents 48, 50, with respect to the base 30 of the adjustable wedge assembly 20. Movement of the door 12 continues until a desired gap is established between the door 12 and the vehicle body 16 of the vehicle 10.

Initially, a pair of fasteners 36 loosely connects the adjustable wedge assembly 20 to the vehicle body 16, with the wedge portion 32 of the adjustable wedge assembly in the outboard position. The fasteners 36 may be any conventional fasteners now know or hereafter discovered, including, but not limited to, bolts, screws, clamps, clips, etc. The fasteners 36 extend through the apertures 52 are of the base portion 30 as well as through the elongate mounting slots 54 of the wedge portion 32. The apertures 52 of the base portion are sized in correspondence to the fasteners 36, such that the base portion 30 is not slidable with respect to the vehicle body 16 when the fasteners 36 are disposed within the apertures 52 to loosely connect the adjustable wedge assembly 20 to the vehicle body 16. However, while the fasteners 36 loosely connect the adjustable wedge assembly 20 to the vehicle body 16, the wedge portion 32 remains slidable with respect to the base portion 30, as the elongate mounting slots 54 are sized to allow the fasteners 36 to travel fore and aft within them. Thus, by connecting the base portion 30 and the wedge portion 32 of the adjustable wedge assembly 20 to the body 16 of the vehicle 10 such that the fasteners 36 are loosely engaged, the position of the wedge portion 32 with respect to the base portion 30 may be adjusted prior to final tightening of the fasteners 36. When the fasteners 36 are tightened, application of reasonable amounts of force is no longer capable of overcoming the restraining force provided by cooperative engagement of the detent 48, 50, thereby fixing the position of the wedge portion 32 with respect to the base portion 30.

Figure 5:
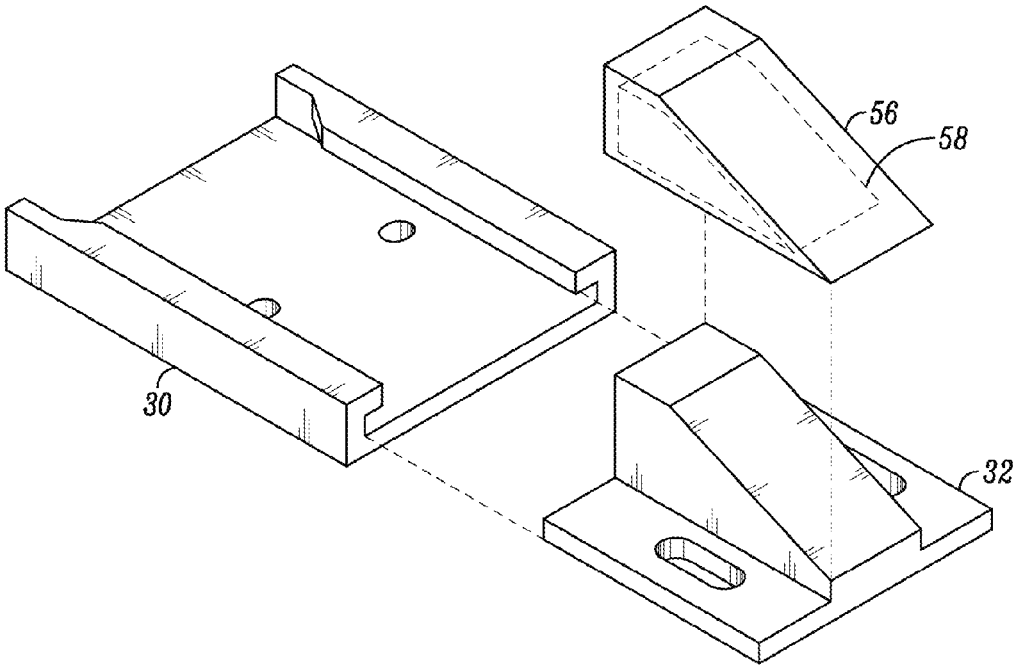
FIG. 5 is an exploded perspective view of a wedge assembly in accordance with another embodiment of the invention.

It should be understood that the spacer 34 could be provided in various forms, so long as it is securable with respect to the wedge portion 32 during assembly of the vehicle 10 and later removable from the adjustable wedge assembly 20. For example, as shown in FIG. 5, a spacer cap 56 could be provided in lieu of the spacer 34. The spacer cap 56 is configured to be disposed over and substantially surround the inclined surface 44 of the wedge portion 32. In particular, an internal cavity 58 of the spacer cap 56 is sized and configured such that the inclined surface 44 is receivable therein along with one or more additional surfaces of the wedge portion 32 to secure the spacer cap 56 with respect to the wedge portion 32. The thickness of the spacer cap 56 is selected to provide the predetermined spacing between the door 12 and the body 16 of the motor vehicle 10.

Figure 6:
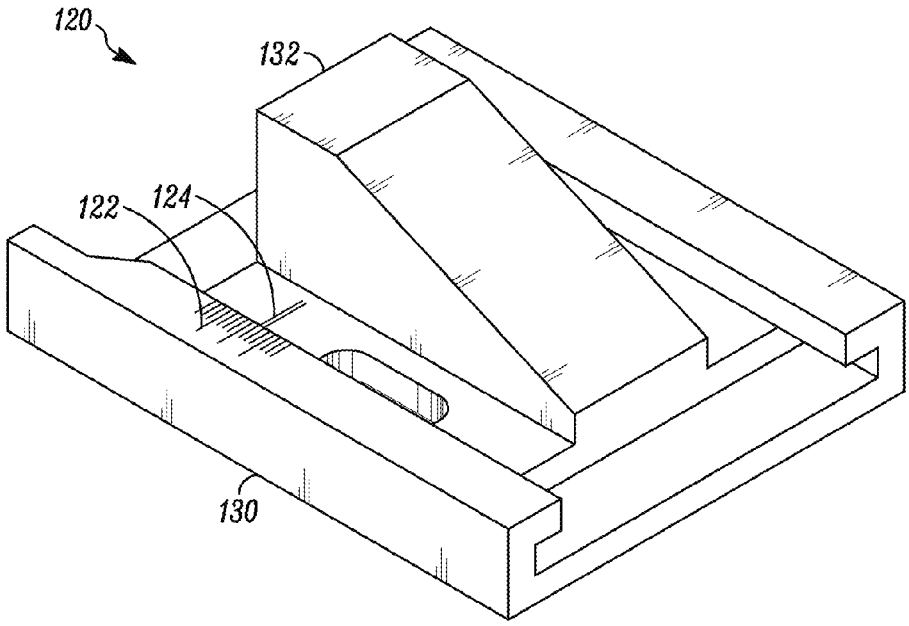
FIG. 6 is a perspective view of a wedge assembly in accordance with another embodiment of the invention.

As shown in FIG. 6, in an alternate adjustable wedge assembly 120, the spacer 34 or similar structure may be omitted. The adjustable wedge assembly 120 includes indicia 122 provided on a base portion 130, while a corresponding position indicator 124 is provided on the wedge portion 132. After the position of the wedge portion 132 with respect to the base portion 130 is adjusted by closing the door 16 of the vehicle 10, the wedge portion 132 is manually moved with respect to the base portion 130 using the position indicator 124 and the indicia 122 to adjust the position of the wedge portion 132 by the desired spacing. For example, the wedge portion 132 may away from the contact surface 26 of the striker 22 so that the position indicator 124 moves by an amount corresponding to a single demarcation on the indicia 122, which corresponds to the desired spacing.

Figure 7:
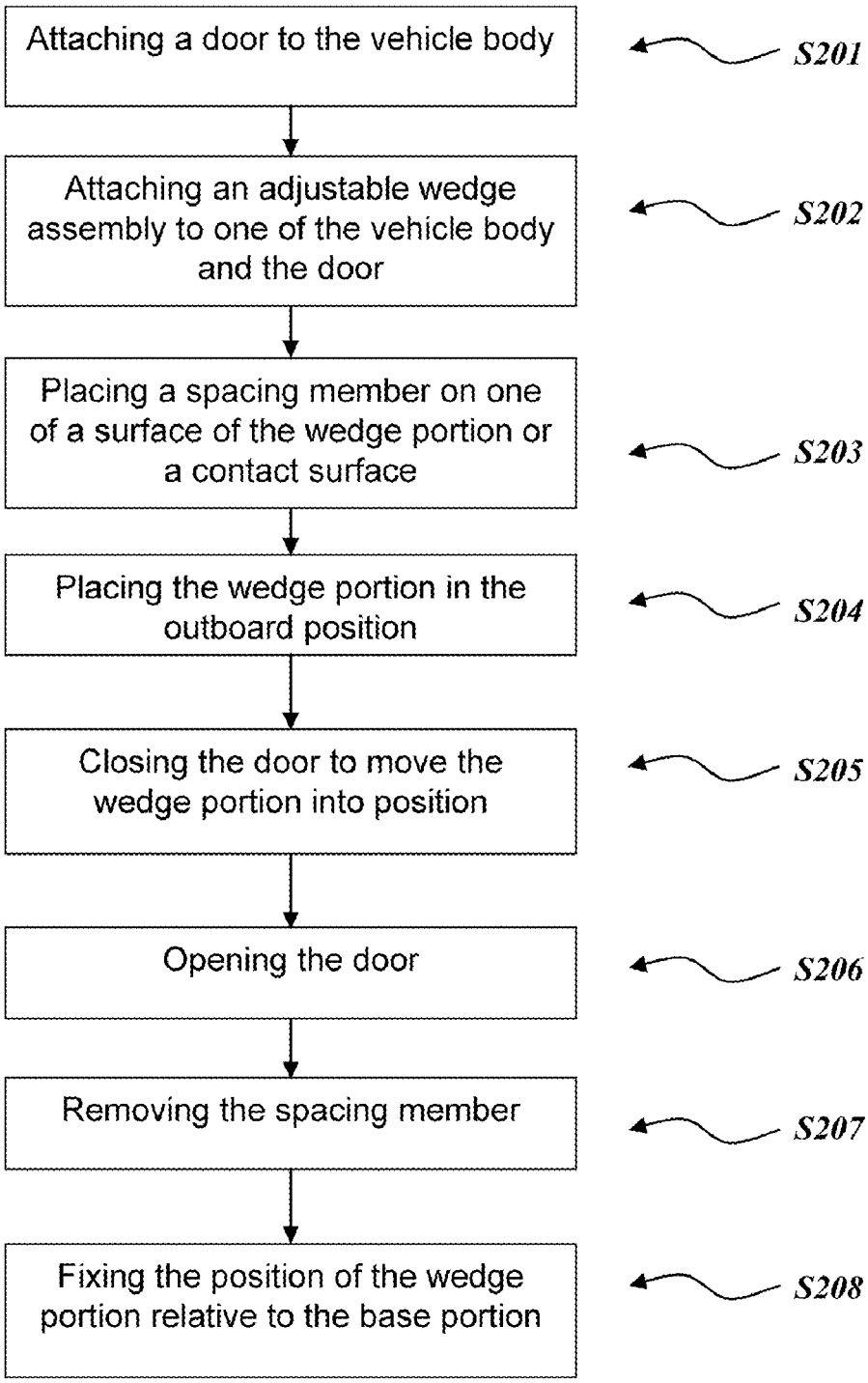
FIG. 7 is a flow chart illustrating a process of assembling the vehicle of FIG. 1.

A method for assembling the vehicle 10 using the adjustable wedge assembly 20 will now be explained with reference to FIG. 7. In step S201, the door 12 is attached to the vehicle body 16 so that the door 12 can open and close the opening 18, and so that a gap exists between the door 12 and the vehicle body 16 when the door 12 closes the opening 18. Next, in step S202, the adjustable wedge assembly 20 is loosely attached to the vehicle body 16 using the fasteners 36. Alternatively, the adjustable wedge assembly 20 could be loosely attached to the door 12 using the fasteners 36 in step S202. In step S203, the spacer 34 is placed on one of the inclined surface 44 of the wedge portion 32 or a contact surface, such as the contact surface 26 of the striker 22. In step S204 the wedge portion 32 is placed in the outboard position. In step S205, the door 12 is closed until the door is placed at a desired distance from the vehicle body 16, thereby moving the wedge portion 32 of the adjustable wedge assembly 20 with respect to the base portion 30 by engagement of the spacer 34 with a contact surface such as the door 12, the vehicle body 16, or the contact surface 26 of the striker 22. The door 12 is then opened in step S206, and the spacer 34 is removed in step S207. Then, in step S208, the position of the wedge portion 32 of the adjustable wedge assembly 20 is fixed relative to the base portion 30 of the adjustable wedge assembly 20 by tightening the fasteners 36.

Figure 8:
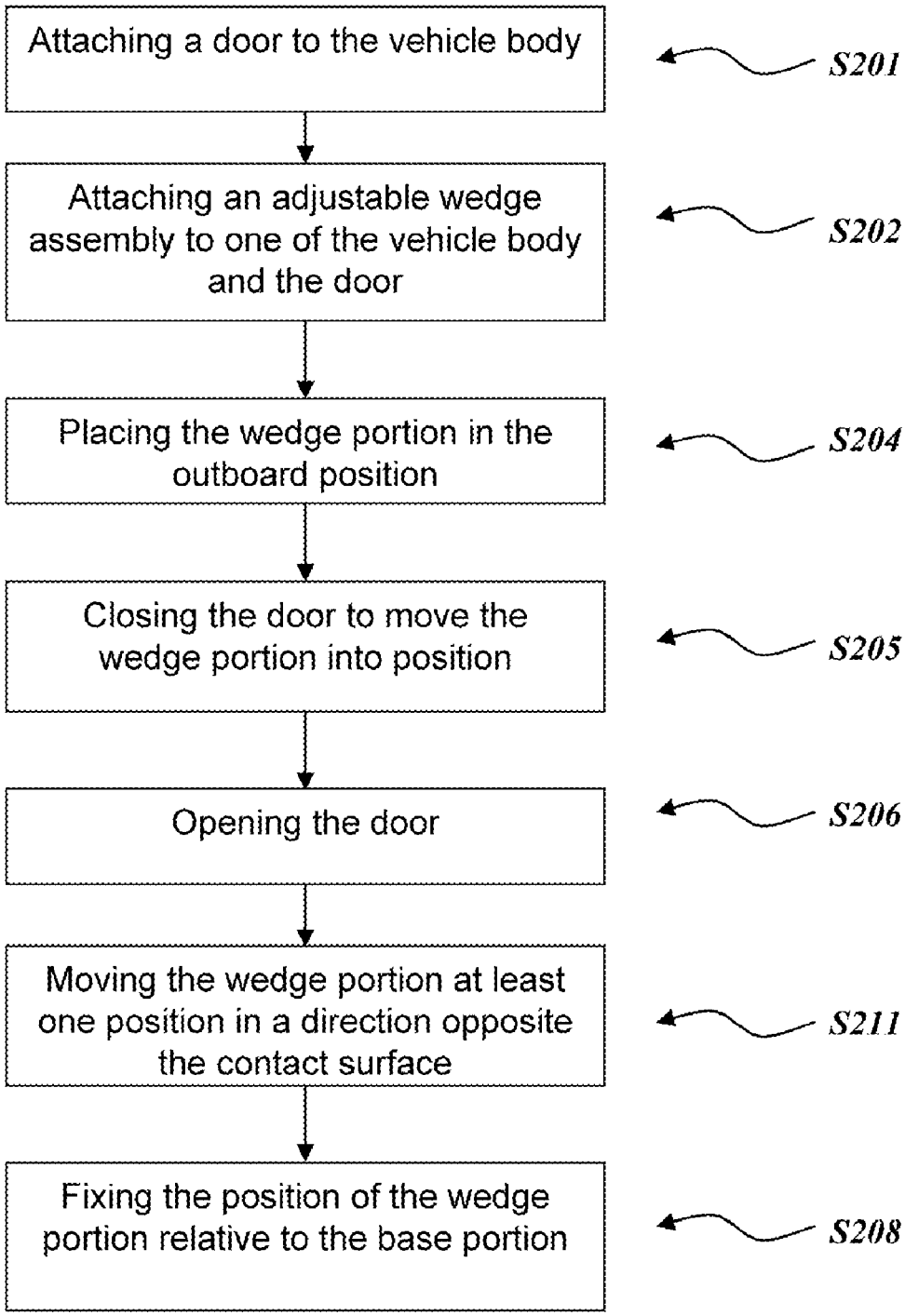
FIG. 8 is a flow chart illustrating an alternative process of assembling the vehicle of FIG. 1.

An alternative method for assembling the vehicle 10 using the alternate adjustable wedge assembly 120 will now be explained with reference to FIG. 8. Steps S201 and S202 are as described in connection with FIG. 8, except that the alternate adjustable wedge assembly 120 is utilized in place of the adjustable wedge assembly 20. Steps S204-S206 follow Step S202 as previously described. After the door is opened in step S206, the wedge portion 132 of the alternate adjustable wedge assembly 120 is moved by one position away toward the inboard position, i.e. in a direction opposite the contact surface, according to the indicia 122 and the position indicator 124, in step S211. The method then proceeds to step S208, the position of the 1 wedge portion 32 of the alternate adjustable wedge assembly 120 is fixed relative to the base portion 130 of the alternate adjustable wedge assembly 120 by tightening the fasteners 36.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A vehicle, comprising:

a vehicle body defining an opening;

a door mounted to the body for movement between a closed position, wherein the door is disposed within the opening, and an open position, wherein the door is at least partially outside of the opening;

an adjustable wedge assembly, the adjustable wedge assembly including:

a base portion fixed to one of the vehicle body and the door, and a wedge portion disposed in a sliding relationship with respect to the base portion such that the wedge portion is movable relative to the base portion between a plurality of positions including a first position, a second position and at least one intermediate position between the first position and the second position;

a contact surface disposed on the other of the vehicle body and the door;

a spacer removably attached to one of the wedge portion and the contact surface during assembly of the vehicle, wherein the spacer is substantially planar and has a thickness that corresponds to a predetermined gap between the wedge portion and the contact surface, and the wedge portion and the contact surface are positioned so that the spacer is interposed between and in engagement with the contact surface and the wedge portion when the door is moved from the open position to the closed position during assembly of the vehicle; and a mechanism to fix the position of the wedge portion relative to the base portion after the door moves from the open to the closed position during assembly of the vehicle, wherein the mechanism includes at least one of a detent or a fastener.

2. The vehicle of claim 1, wherein the spacer is attached to the wedge portion so that the spacer is interposed between the wedge portion and the contact surface when the door moves from the open position to the closed position during assembly of the vehicle.

3. The vehicle of claim 1, wherein at least one of the spacer and the contact surface includes posts and the other of the spacer and the contact surface defines apertures corresponding to the posts and sized to snugly receive the posts, wherein the posts and apertures are configured to align the spacer with respect to the wedge portion.

4. The vehicle of claim 1, wherein at least one of the spacer and the wedge portion includes posts and the other of the spacer and the wedge portion defines apertures corresponding to the posts and sized to snugly receive the posts, wherein the posts and apertures are configured to align the spacer with respect to the wedge portion.

5. The vehicle of claim 1, wherein the spacer is contoured to snugly engage at least two surfaces of the wedge portion.

6. The vehicle of claim 1, wherein the spacer is of a thickness of between about 1 mm and about 5 mm.

7. The vehicle of claim 1, wherein the spacer is made of a rigid material.

8. The vehicle of claim 1, further comprising a striker portion defining the contact surface.

9. The vehicle of claim 8, wherein the wedge portion has a first wedge surface, the striker portion has a second wedge surface, the first wedge surface is aligned with the second wedge surface when the door is in the closed position, and the spacer is interposed between and in engagement with the first wedge surface and the second wedge surface when the door is moved from the open position to the closed position during assembly of the vehicle.

10. The vehicle of claim 1, wherein the first position, the second position and the at least one intermediate position are each defined by a detent located on one of the base portion and the wedge portion.

11. A method for assembling a vehicle door for a vehicle, with the vehicle having a vehicle body defining an opening, the method comprising:

pivotally attaching a door to the vehicle body so that the door is movable between an open position and a closed position;

attaching an adjustable wedge assembly to one of the vehicle body and the door, the adjustable wedge including a base portion fixed to one of the vehicle body and the door, and a wedge portion disposed in a sliding relationship with respect to the base portion such that the wedge portion is movable relative to the base between a plurality of positions including a first position, a second position and at least one intermediate position between the first position and the second position, wherein the adjustable wedge assembly is configured and arranged so that the adjustable wedge assembly comes into contact with a contact surface located on the other of the door and the body when the door is in the closed position;

placing a spacer on one of the contact surface or the wedge portion, wherein the spacer is substantially planar and has a thickness that corresponds to a predetermined gap between the wedge portion and the contact surface;

placing the wedge portion in the first position;

moving the door to the closed position so that the spacer is interposed between and in engagement with the contact surface and the wedge to move the wedge portion from the first position to one of the second position and the intermediate position;

moving the door to the open position;

removing the spacer; and fixing the position of the wedge relative to the base portion.

12. The method of claim 11, wherein the spacer is of a thickness of between about 1 mm and about 5 mm.

13. The method of claim 11, wherein at least one of the spacer and the contact surface includes posts and the other of the spacer and the contact surface defines apertures corresponding to the posts and sized to snugly receive the posts, wherein the posts and apertures are configured to align the spacer with respect to the wedge portion.

14. The method of claim 11, wherein at least one of the spacer and the wedge portion includes posts and the other of the spacer and the wedge portion defines apertures corresponding to the posts and sized to snugly receive the posts, wherein the posts and apertures are configured to align the spacer with respect to the wedge portion.

15. The method of claim 11, wherein the spacer is contoured to snugly engage at least two surfaces of the wedge portion.

16. The method of claim 11, wherein the first position, the second position and the at least one intermediate position are each defined by a detent located on one of the base portion and the wedge portion.

17. A method for assembling a a vehicle door for a vehicle, with the vehicle having a vehicle body defining an opening, the method comprising:

attaching a door to the vehicle body so that the door is movable between an open position and a closed position;

attaching an adjustable wedge assembly to one of the vehicle body and the door, the adjustable wedge including a base portion fixed to one of the vehicle body and the door, and a wedge portion disposed in a sliding relationship with respect to the base portion such that the wedge portion is movable relative to the base between a plurality of positions including a first position, a second position and at least one intermediate position between the first position and second position, wherein the adjustable wedge assembly is configured and arranged so that the adjustable wedge assembly comes into contact with a contact surface located on the other of the door and the body when the door closes the opening;

placing the wedge portion in the first position;

closing the door to move the wedge portion one or more positions away from the first position to one of the intermediate positions; and subsequent to closing the door to move the wedge portion one or more positions away from the first position to one of the intermediate positions:

opening the door, moving the wedge portion at least one more position away from the first position, and fixing the position of the wedge portion relative to the base portion.

18. The method of claim 17, wherein the adjustable wedge assembly includes indicia located on one of the base portion and the wedge portion, the indicia corresponding to at least two positions.

19. The method of claim 17, wherein the first position, the second position and the at least one intermediate position are each defined by a detent located on one of the base portion and the wedge portion.

20. A vehicle, comprising:

a vehicle body defining an opening;

a door mounted to the body for movement between a closed position, wherein the door is disposed within the opening, and an open position, wherein the door is at least partially outside of the opening;

an adjustable wedge assembly including a base portion fixed to the vehicle body and a wedge portion disposed in a sliding relationship with respect to the base portion such that the wedge portion is movable relative to the base portion between a plurality of positions including an first position, an second position and at least one intermediate position between the first position and the second position, the wedge portion defining a first wedge surface;

a striker portion defining a second wedge surface, wherein the first wedge surface is aligned with the second wedge surface when the door is in the closed position;

a spacer removably attached to the wedge portion, wherein the spacer is substantially planar and has a thickness that corresponds to a predetermined gap between the first wedge surface of the wedge portion and the second wedge surface of the striker portion, and the wedge portion and the striker portion are positioned so that the spacer is interposed between and in engagement with the first wedge surface and the second wedge surface when the door is moved from the open position to the closed position during assembly of the vehicle; and a mechanism to fix the position of the wedge portion relative to the base portion after the door moves from the open to the closed position during assembly of the vehicle, wherein the mechanism includes at least one of a detent or a fastener.

21. The vehicle of claim 1, wherein the spacer has a first substantially planar surface that is engageable with the wedge portion and a second substantially planar face that is engageable with the contact surface.

* * * * *